US008131200B2

(12) United States Patent
Ushikubo

(10) Patent No.: US 8,131,200 B2
(45) Date of Patent: Mar. 6, 2012

(54) CLEANING DEVICE AND IMAGE FORMING DEVICE

(75) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 309 days.

(21) Appl. No.: 12/402,334

(22) Filed: Mar. 11, 2009

(65) Prior Publication Data

US 2009/0232559 A1 Sep. 17, 2009

(30) Foreign Application Priority Data

Mar. 12, 2008 (JP) ..... 2008-062773

(51) Int. Cl.
*G03G 21/00* (2006.01)

(52) U.S. Cl. ..... 399/358

(58) Field of Classification Search ..... 399/123, 399/343, 350, 351, 353, 358, 359
See application file for complete search history.

(56) References Cited

U.S. PATENT DOCUMENTS

| | | | | |
|---|---|---|---|---|
| 5,956,556 | A * | 9/1999 | Nakajima et al. | 399/359 |
| 7,049,037 | B2 * | 5/2006 | Katoh et al. | 430/47.2 |
| 7,773,933 | B2 * | 8/2010 | Ishino et al. | 399/349 |

FOREIGN PATENT DOCUMENTS

| | | | |
|---|---|---|---|
| JP | U-S60-178857 | | 11/1985 |
| JP | A-2001-042733 | | 2/2001 |
| JP | 2003-195715 | A | 7/2003 |
| JP | 2005-301019 | A | 10/2005 |
| JP | 2006-078532 | A | 3/2006 |
| JP | 2006-330316 | A | 12/2006 |
| JP | A-2007-147773 | | 6/2007 |

OTHER PUBLICATIONS

Office Action dated Feb. 12, 2010 from Japan Patent Office in corresponding JP application No. 2008-062773.

* cited by examiner

*Primary Examiner* — Hoan Tran

(74) *Attorney, Agent, or Firm* — Posz Law Group, PLC

(57) ABSTRACT

A cleaning device includes a cleaning member for removing developer attached to a developer attaching member; a rotation carrying member which is rotatably configured to carry the developer that is removed by the cleaning member; a housing member for housing the developer that is removed by the cleaning member and configured as a part of a developer housing part that surrounds the rotation carrying member; and an elastic member arranged to contact a periphery of the rotation carrying member.

18 Claims, 6 Drawing Sheets

CLEANING DEVICE AND IMAGE FORMING DEVICE

CROSS REFERENCE TO RELATED APPLICATION

The present application is related to, claims priority from and incorporates by reference Japanese Patent Application No. 2008-062773, filed on Mar. 12, 2008.

TECHNICAL FIELD

The present invention is related to cleaning devices, and particularly to an image forming device that includes a cleaning device for removing waste developer/toner.

BACKGROUND

Conventionally, with respect to an image forming device such as a printer, a toner image can be formed as follows: i) when a surface of a photoconductive drum is charged by an electrostatic charge roller, an electrostatic latent image is formed by exposure to a light emitting diode (LED) head; ii) toner that is formed in a thin-film status oil the developer roller is electrostatically attached on the electrostatic latent image to form a toner image; iii) the toner image is transferred to a sheet by a transfer roller, and affixed by a fuser, and the image is formed. Moreover, toner remaining on the photoconductive drum after the toner image is transferred is scraped by a cleaning blade and collected as waste toner. Moreover, waste developer is created by the waste toner.

Waste toner collected by the cleaning blade is carried by a toner carrying device and discarded after it is sent to a waste toner box. In order to do so, the toner carrying device has a coil-shaped carrying spiral or the like and carries the waste toner by rotating the carrying spiral. See, for example, Japanese Laid-Open Application Publication No. 2006-78532.

However, with respect to the conventional printer that is discussed above, when the printer is placed in a high-humidity environment and the inside of the printer main body reaches a high temperature, the waste toner absorbs moisture, and a temperature of the waste toner rises. When pressure is added to the waste toner corresponding to rotation of the carrying spiral in this condition, the waste toner is flocculated around the carrying spiral and becomes attached to a periphery of the carrying spiral.

As a result, the waste toner cannot be smoothly carried to the waste toner box.

SUMMARY

Accordingly, a cleaning device and an image forming device are provided that can smoothly carry waste developer (or developer) by alleviating the problems of the above described conventional printer.

In order to do so, a cleaning member is provided for removing developer attached to a developer attaching member; a rotation carrying member which is rotatably configured to carry the developer that is removed by the cleaning member; a housing member for housing the developer that is removed by the cleaning member and configured as a part of a developer housing part that surrounds the rotation carrying member; and an elastic member arranged to contact a periphery of the rotation carrying member.

Accordingly, because the elastic member is arranged to contact the periphery of the rotation carrying member, the elastic member can scrap the developer attached on the periphery of the rotating carrying member. Therefore, the rotation carrying member can smoothly carry the developer.

DETAILED DESCRIPTION

Hereafter, embodiments of the present invention are explained with reference to the drawings. The printer as an image forming device is explained.

Each image forming unit (ID unit) 10Bk, 10Y, 10M and 10C has an identical structure. Therefore, only the image forming unit 10Bk is shown in the FIGS. 3-5 and discussed in detail below.

Figure 2:
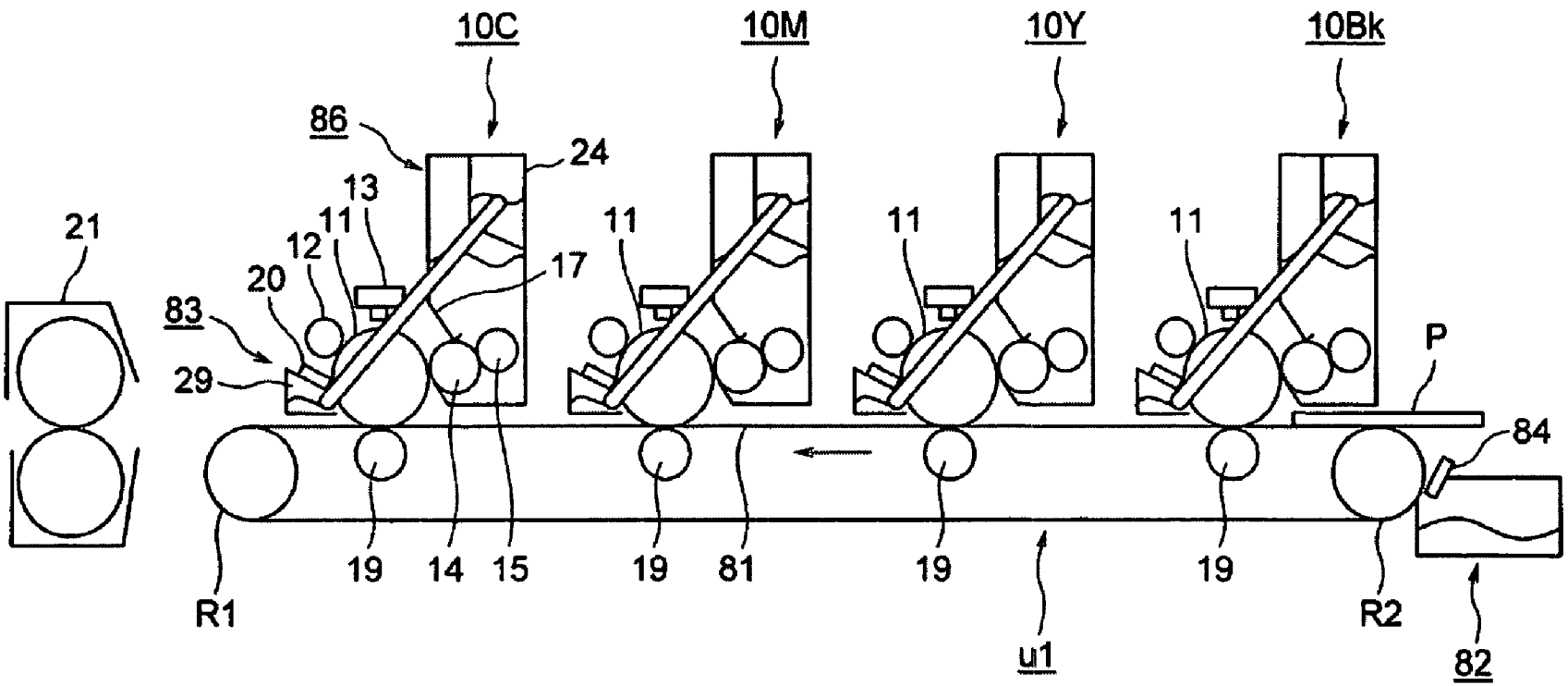
FIG. 2 is a schematic diagram of the printer of the first embodiment.
Figure 5:
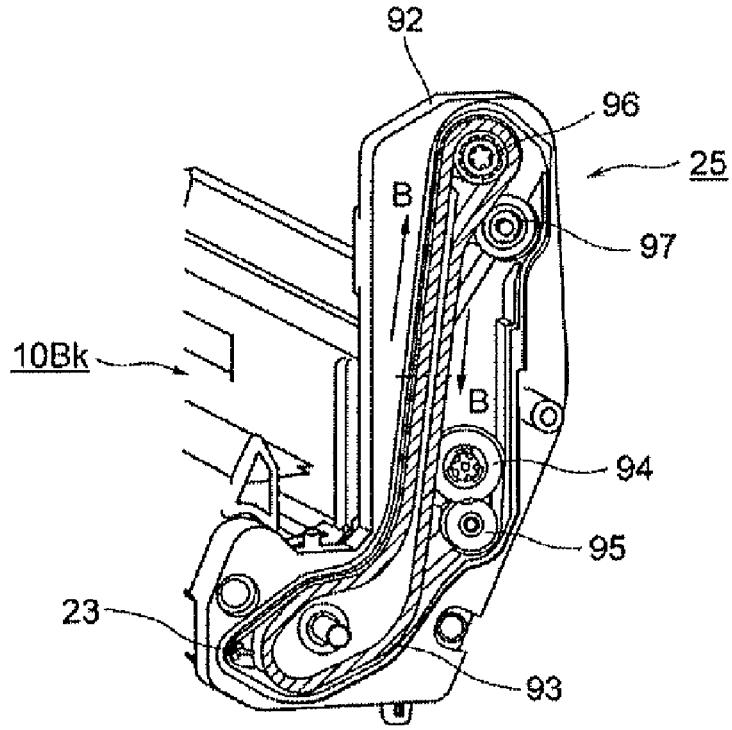
FIG. 5 is a cross sectional view of the waste toner carrying structure of the first embodiment.

As primarily shown in FIGS. 2 and 5, the printer includes follows: image forming units 10Bk, 10Y, 10M and 10C that form respective toner images as a developer image in black, yellow, magenta, and cyanogens colors corresponding to the image data; an LED head 13 arranged in an opposed position relative to the photoconductive drums each of which is an image carrier and a first developer attaching member of each of the image forming units of 10Bk, 10Y, 10M and 10C, and as the lithography device that forms an electrostatic latent image (latent image) by exposing each photoconductive drum 11; a belt type transfer unit u1 that is arranged in an opposite position with the image forming units 10Bk, 10Y, 10M and 10C, forms a transfer area for each color between the belt type transfer unit u1 and each of the image forming units 10Bk, 10Y, 10M and 10C, transfers a toner image of each color as a medium on a paper P, and forms an color image; a paper supply cassette not shown in the figure as a medium housing part that houses the paper P and supplies the paper P to each transfer area; and a fuser 21 as a fixing device to fix the toner image after being transferred at each of the transfer area; and so on.

The transfer unit u1 includes a drive roller R1 as a first roller that is connected to a motor not shown in the figure that rotates by a rotation of the motor, a driven roller R2 as a second roller that is driven and rotated along with the rotation of the drive roller R1, and an endless belt 81 that includes a predetermined tension by the drive roller R1 and the driven roller R2. The endless belt 81 operates as a transfer belt which runs in a direction indicated by direction arrow A of FIG. 2 and as the second developer attaching member. The transfer unit u1 also includes a transfer roller 19 as a transfer member that is rotatably arranged to the opposite position to the photoconductive drum 11 in the endless belt 81, and a first cleaning device 82 that is arranged relative to and contacts an outer surface of the endless belt 81 adjacent to the driven roller R2. The first cleaning device 82 removes toner, as waste toner, that is attached on the endless belt 81 from the photoconductive drum 11 during the forming of a toner image or transferring the toner image onto the paper P. The toner functions as a developer that forms a pattern of a toner image that to correct a density or color shift on the endless belt 81. In the present embodiment, a tension is added to the endless belt 81 by the driven roller R2. However, the tension can be added to the endless belt 81 using a tension roller that is newly arranged.

Moreover, each of the image forming units of 10Bk, 10Y, 10M and 10C has an identical structure, and includes the photoconductive drums 11 that are rotatably arranged, the electrostatic charge rollers 12, as a electrostatic charge, that are arranged along the rotation direction of the photoconductive drum 11, a developing roller 14 as a developer carrying body, a toner supplying roller 15, as a developer supplying member, a developing blade 17 as a developer restricting member, and a second cleaning device 83 or the like. Further, the LED head 13 is arranged opposite the photo conductive drum 11 between the photoconductive roller 12 and the developing roller 14 and exposes the surface of the photoconductive drum 11 and forms an electrostatic latent image.

Moreover, the first cleaning device 82 includes a cleaning blade 84 as the first cleaning member. The cleaning blade 84 scrapes the toner attached on the endless belt 81.

Figure 3:
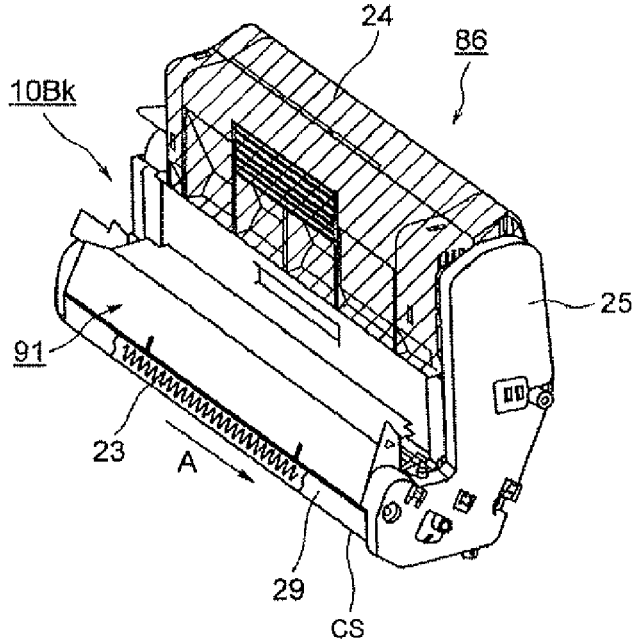
FIG. 3 is a perspective view of the image forming unit of the first embodiment.
Figure 4:
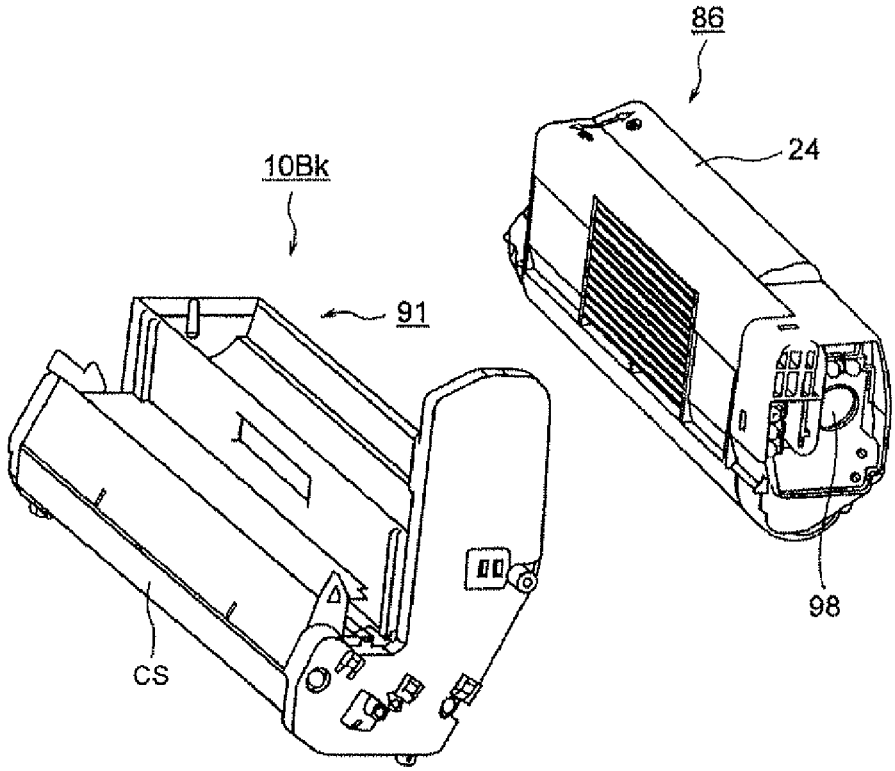
FIG. 4 is a decomposed perspective view of the image forming unit of the first embodiment.

Further, as shown in FIGS. 3 and 4, the second cleaning device 83 is arranged on a housing part CS (housing or housing member) that is formed together with the cases of each of the image forming units of 10Bk, 10Y, 10M and 10C, and includes a waste toner containing part 29 as a waste developer housing part that is formed in the axis direction along with the photoconductive drum 11 and as a waste developer carrying path, the cleaning blade 20 as the second cleaning member that is attached in the predetermined place of the housing part CS, and a carrying spiral 23 as the first carrying member that is rotatably arranged at the bottom part of the cleaning blade 20 in the waste toner containing part 29, and as a rotation carrying member. The cleaning blade 20 scrapes the toner remaining on the photoconductive drum 11 as waste toner after being transferred. Moreover, the housing part CS is configured as a part of the waste toner containing part 29. Moreover, the waste developer is formed by the waste toner.

Further, the transfer spiral 23 is rotatably arranged inside of the waste toner containing part 29, is connected to the drive motor as the drive part, which is not shown in the figure in order to rotate the photoconductive drum 11, is rotated according to a rotation of the drive motor, and carries the scraped waste toner by the cleaning blade 20 to the arrow direction A of FIG. 3.

At the upper part of the developing roller 14, a toner cartridge 86, as a developer cartridge, is removably arranged with respect to the main body of the image forming units of 10Bk, 10Y, 10M and 10C to an image forming unit main body 91, and the toner is housed in the toner cartridge 86. The toner is composed of polyester resin (glass transition temperature Tg is 40° C.), coloring agent, electrostatic controlling agent, mold release agent or the like, and an externally added agent (hydrophobic silica) is added. Moreover, the toner has a pulverized shape obtained by a grinding technique, and the average powder diameter is 8 μm.

Further, the waste toner tank 24 as a waste developer housing container is housed in the main body of the toner cartridge 86 inside of the container main body, and the waste toner is housed in the waste toner tank 24. Moreover, the second cleaning device 83 and the waste toner tank 24 are connected with a waste toner carrying mechanism 25 as a waste developer carrying mechanism.

The waste toner carrying mechanism 25 is arranged at one end of the image forming units of 10Bk, 10Y, 10M and 10C, and, in the present embodiment, is arranged at the right end when viewed from lower side of the carrying direction of the paper P as shown FIG. 5. The waste toner carrying mechanism 25 includes, inside of the side plate 92, a carrying belt 93 having gears, as a second carrying member, that is arranged so that it can travel, a gear 94 that is rotatably arranged with the carrying belt 93, a drive gear 95 that is rotatably arranged with the gear 94, a pulley 96 that is rotated along with the carrying belt 93 and that guides the carrying belt 93 so that the carrying belt 93 does not receive sliding loads, and an exhaust spiral 97 that is rotated corresponding to the carrying belt 93, and that functions as an exhaust member that exhausts the waste toner carried by the carrying belt 93 to the waste toner tank 24 or the like.

The drive gear 95 is connected to a carrying belt motor that is not shown in the figure as a drive pail for carrying the waste toner. When the drive gear 95 is rotated by driving the carrying belt motor, the carrying belt 93 moves in a direction indicated by direction arrow B. Accordingly, the waste toner that is sent by the carrying spiral 23 is exhausted in the waste toner tank 24 by the exhaust spiral 97 after it is scraped by grooves between each gear of the carrying belt 93. For the process, an exhaust opening 98 to exhaust the waste toner is formed at the side of the toner cartridge 86.

Next, operation of the aforementioned printer is explained with reference to FIG. 2.

When the printing process starts, the controlling part which is not shown in the figure rotates the photoconductive drum 11, the electrostatic charge roller 12, the developing roller 14, the toner supplying roller 15 or the like, runs the endless belt 81 and charges the photoconductive drum 11, the electrostatic charge roller 12, the developing roller 14 and the toner supplying roller 15. Accordingly, the electrostatic roller 12 uniformly electrically charges a surface of the photoconductive drum 11 at each of the image forming units 10Bk, 10Y, 10M and 10C. Next, the controlling part sends image data to the LED head 13, exposes a charged surface of the photoconductive drum 11 by the LED head 13, and forms an electrostatic latent image.

On the other hand, the toner supplied to the image forming unit main body 91 from the toner cartridge 86 is supplied to the developing roller 14 by the toner supplying roller 15, is thinned by the developing blade 17 at the developing roller 14, and is attached on the photoconductive drum 11, and the electrostatic latent image is developed and a toner image of each color is formed. Next, the paper P is sent to the fuser 21. At the fuser 21, a color toner image is fixed on the paper P, and the color image is formed. The printing operation is then completed.

Further, after the toner image of each color is transferred to the paper P, the toner remaining on the photoconductive drum 11 is scraped by the cleaning blade 20. The scraped toner is housed in the waste toner containing part 29 as waste toner, is sent to the waste toner carrying structure 25 by the carrying spiral 23, and then is sent to the waste toner tank 24 by the toner carrying structure 25.

The second cleaning device 83 is explained with reference to FIGS. 1, 6 and 7.

Figure 1:
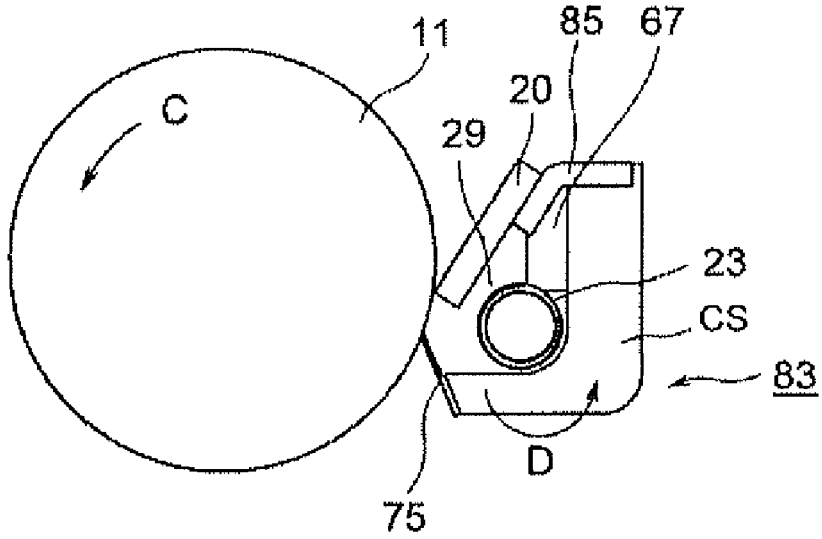
FIG. 1 illustrates an arrangement condition of the second cleaning device of the first embodiment.

FIG. 1 shows an arrangement condition of the second cleaning device of the first embodiment. FIG. 6 shows a carrying condition of the waste toner of the first embodiment.

Figure 6:
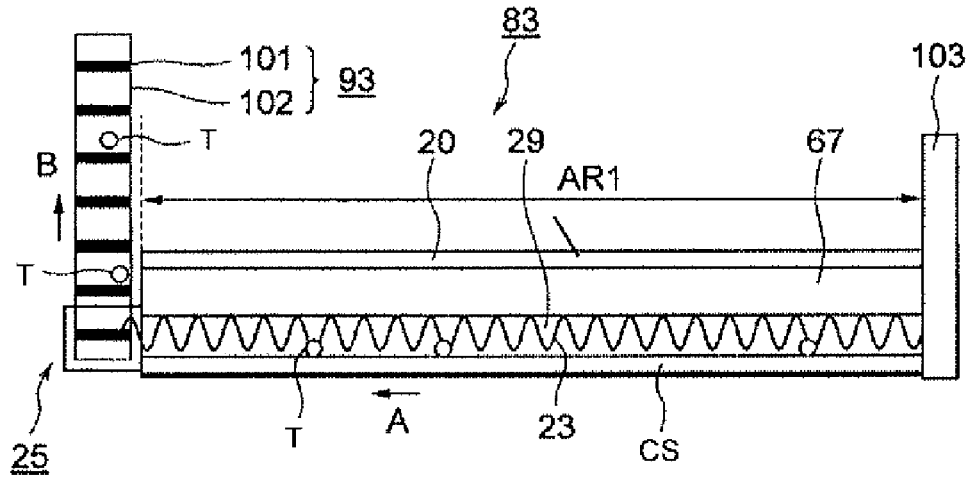
FIG. 6 illustrates the carrying condition of the waste toner of the first embodiment.
Figure 7A:
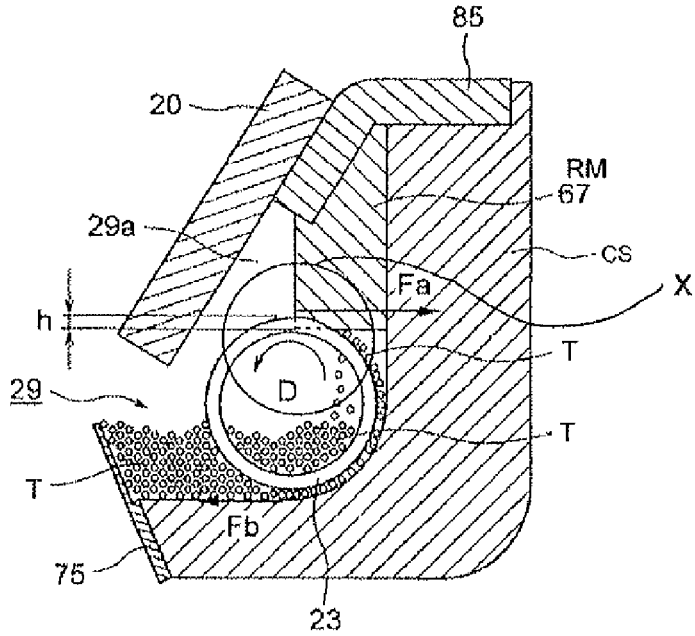
FIG. 7A illustrates the scraping condition of the remaining toner of the first embodiment.
Figure 7B:
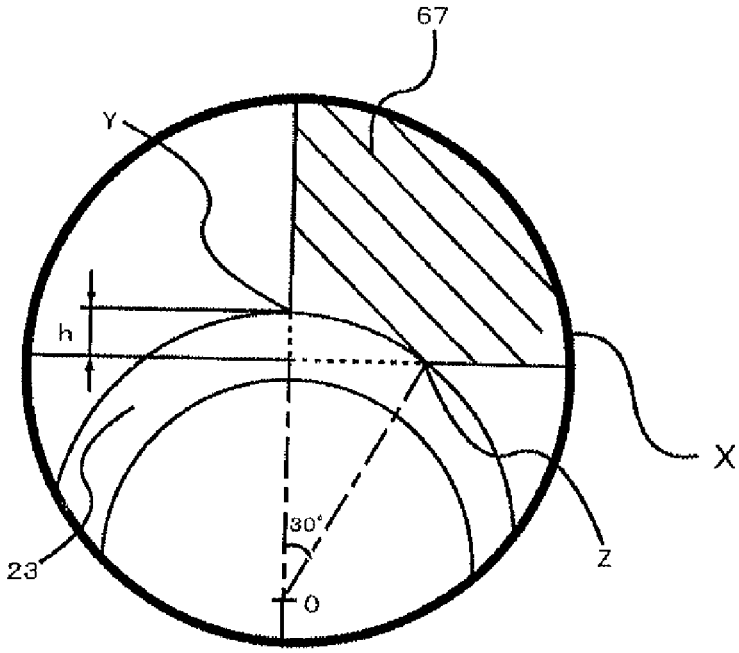
FIG. 7B illustrates an enlarged view of a circle X shown in FIG. 7B

FIG. 7A shows a scraping condition of the remaining toner of the first embodiment. FIG. 7B shows an enlarged view of a contact area of a sponge member and a carrying spiral. Moreover, FIG. 6 shows a condition when the second cleaning device 83 is viewed from a side of the photoconductor drum 11.

The above figures show a photoconductive drum 11 which is rotatably arranged, a cleaning blade 20, a carrying spiral 23, a waste toner containing part 29, a second cleaning device 83, and an angled plate shaped support member 85. The supporting member 85 is fixed on the housing part CS at one end, and supports the cleaning blade 20 at the other end.

The cleaning blade 20 is formed of urethane rubber, and is arranged so that an edge is pushed against the surface of the photoconductive drum 11. The cleaning blade 20 scrapes toner remaining on the photoconductive drum 11 during rotation of the photoconductive drum 11 and drops the toner in the waste toner containing part 29.

Moreover, the carrying spiral 23 is formed by coiling a wire rod made of stainless steel or the like whose cross section has a circular shape and a 1 mm diameter, and the coiled periphery is 10 mm. The carrying spiral 23 is arranged to have a predetermined distance from the photoconductive drum 11 and to be parallel with a rotating axis of the photoconductive drum 11 in the waste toner containing part 29.

Moreover, a drive gear which is not shown in the figure is attached at an edge of the carrying spiral 23, namely at an end part where the carrying belt 93 is not arranged. The drive gear and the other drive gear attached on the photoconductive drum 11 are connected through a driven gear which is not shown in the figure. Accordingly, the carrying spiral 23 is rotated in the same direction as the photoconductive drum 11 in a direction indicated by the arrow D when the photoconductive drum 11 is rotated in a direction indicated by the arrow C by the drive motor. Further, a rotating speed of the carrying spiral 23 is synchronized with a rotating speed of the photoconductive drum 11.

Further, a waste toner delivering pail is formed at a connecting part of the waste toner carrying structure 25 and at one end of the waste toner containing part 29. At the waste toner delivering part, the carrying spiral 23 and the carrying belt 93 are adjacent one another. The carrying belt 93 includes a plurality of teeth parts 102, as a carrying part, that are made of a flexible plastic, and that are extruded with even pitches (intervals) on the outside of a belt main body 101.

When the carrying spiral 23 is rotated by the drive motor, the carrying spiral 23 carries the toner that is dropped on the waste toner containing part 29, as waste toner T, toward a direction indicated by the arrow A, and sends it to the waste toner delivering part.

Moreover, a film 75, as a sealing member, is attached by a double sided tape, as an adhesive member, (not shown the figures) at the lower end of the housing part CS. The film 75 seals a gap between the photoconductive drum 11 and the housing part CS, and the film 75 prevents the waste toner T in the waste toner containing part 29 from dropping downwardly.

When the printer is stationed in a high-humidity environment, and an inside temperature of the device main body becomes high, the waste toner T absorbs moisture, and the temperature of the waste toner T increases. When pressure is applied to the waste toner T as a result of the rotation of the carrying spiral 23 in this condition, the waste toner T flocculates around the carrying spiral 23, and attaches to a periphery of the carrying spiral 23.

Further, when the carrying spiral 23 is rotated, the waste toner T is carried in a direction indicated by the arrow A in the space of the carrying spiral 23, and the waste toner T attached on the periphery of the carrying spiral 23 only rotates along with the rotation of the carrying spiral 23. Therefore, the waste toner is not carried away.

As shown in FIG. 6, at the upper part of the carrying spiral 23 in the waste toner containing part 29, a sponge member 67, as a scraping member, and an elastic member are arranged so that the lower end of the sponge member 67 contacts the periphery of the carrying spiral 23 over the entire area AR1 of the waste toner containing part 29 that is from the waste toner carrying structure 25 to the wall body 103 located at the other side, and also at the upper side of the cleaning blade 20 in the rotating direction of the carrying spiral 23 as shown in FIG. 7A. The sponge member 67 is formed of an ester-type sponge with a thickness of 5 mm. As shown in FIG. 1, the sponge member 67 has a trapezoidal shaped cross section, and its upper surface is pressed against a back surface of the supporting member 85. Also, its side surface is pressed to the inner wall of the housing part CS, and is attached to the housing part CS by the double sided tape, as an adhesive member, which is not shown in the figure. Further, the bottom surface of the sponge member 67 is arranged so that it is pushed against the upper end part of the carrying spiral 23. In the embodiment of the present embodiment, the sponge member 67 is installed in the housing part CS. However, it can be installed in the supporting member 85 or in both the housing part CS and the supporting member 85.

Moreover; as shown in FIGS. 7A and 7B, a crushing amount h of the sponge member 67 is in the range of 0.1 mm to 0.5 mm. The amount h can be defined as an engaging amount of the sponge member 67 and the carrying spiral 23. Accordingly, the resulting force on the surface of the carrying spiral 23 becomes small.

Also, when a position that the carrying spiral 23 first contacts the sponge member 67 during the rotation is defined as a contact starting position, when the highest point of the carrying spiral 23 is set as 0° (point Y), the contact starting position is set at the position of +30° (point Z) in a clockwise direction in FIG. 7B. The deformed area of the sponge member 67 in FIG. 7B is defined by an arc Y to Z, downward dotted line from Y, and horizontal dotted line from X. However the contact starting position can be set at a predetermined position in the range of −60° to +60°. Additionally, with respect to the rotation of the carrying spiral 23, a portion of the sponge member 67 is defined as upstream from the cleaning blade 20.

Further, when the carrying spiral 23 is rotated, the waste toner T attached on the periphery of the carrying spiral 23 reaches a vicinity of the upper end of the carrying spiral 23 along with the rotation in the direction of the arrow D of the carrying spiral 23. The waste toner T contacts the sponge member 67. Then, the waste toner T is scraped by the sponge member 67, drops in the waste toner containing part 29, and is securely contained inside the carrying spiral 23. Accordingly, an adequate amount of the waste toner T is carried by the carrying spiral 23 to the waste toner delivering part.

Moreover, because entry of the waste toner T attached on the periphery of the carrying spiral 23 into a space 29*a* of the back side of the cleaning blade 20 is prevented, the flocculation of the waste toner T in a vicinity of the cleaning blade 20 also can be prevented.

Moreover; because the carrying spiral 23 contacts the sponge member 67 at the upper end, it receives a reaction force Fa in a direction away from the photoconductive drum 11, and receives the reaction force Fb in the direction closer to the photoconductive drum 11 due to friction with the housing part CS at the bottom end.

In this case, the carrying spiral 23 is rotated in a direction (that is counter-clockwise in FIG. 7B). In this direction, the periphery of the carrying spiral 23 passes through the sponge member 67 from the housing part CS at the upper part, and the periphery moves toward the housing part CS. Further, the periphery moves toward the housing part CS from the cleaning blade 20. Subsequently, a contacting area of the carrying spiral 23 and the sponge member 67 is larger than another contacting area of the carrying spiral 23 and the housing part CS. Moreover, as a friction coefficient of the sponge member 67 is larger than the friction coefficient of the housing part CS, the reaction force Fa is larger than the reaction force Fb. Accordingly, the carrying spiral 23 can smoothly carry the waste toner T as it can stably rotate without shifting to the photoconductive drum 11 side or without deviating (winding) in the waste toner containing part 29.

Moreover, as the carrying spiral 23 does not contact the cleaning blade 20 by shifting towards the photoconductive drum 11 side, the toner on the photoconductive drum 11 from passing through the cleaning blade 20 or from damaging the cleaning blade 20 can be prevented.

Accordingly, in the present embodiment, the sponge member 67 is arranged so as to be pushed against the periphery of the carrying spiral 23, and the waste toner T attached on the periphery of the carrying spiral 23 can be scraped. Therefore, the waste toner T can be smoothly carried by the carrying spiral 23.

Moreover, as a space between the housing part CS and the supporting member 85 is covered and sealed by the sponge member 67, the waste toner T can be prevented from leaking through the outside of the waste toner containing part 29. Moreover, it is preferable to form a sponge of the sponge member 67 with a closed cell polyfoam; however; an interconnected cell polyfoam can be also used.

Consequently, as the waste toner T has a function as a lubricant agent, a friction force occurring between the carrying spiral 23 and the sponge member 67 can be small. Accordingly, the sponge member 67 does not apply a large load to the rotation of the carrying spiral 23.

Next, the second embodiment of the present invention is explained. Moreover, like numbers are applied to parts or units having the identical structure of the first embodiment, and the effects that are derived from the identical structures are incorporated with the effects described above. Further, with respect to the present embodiment, a rotating carrying member of a cleaning device for a waste toner is described. However, the present invention may be adopted to another rotating carrying member of a cleaning device for recycle toner (or recycle developer). Herein, the term, recycle toner or recycle developer, is defined as toner that has been used once for developing at the photoconductive drum 11 and then returned to the toner cartridge 86. When the toner returns to the toner cartridge 86, the returned toner is mixed with toner that has not yet been used for developing.

Figure 8:
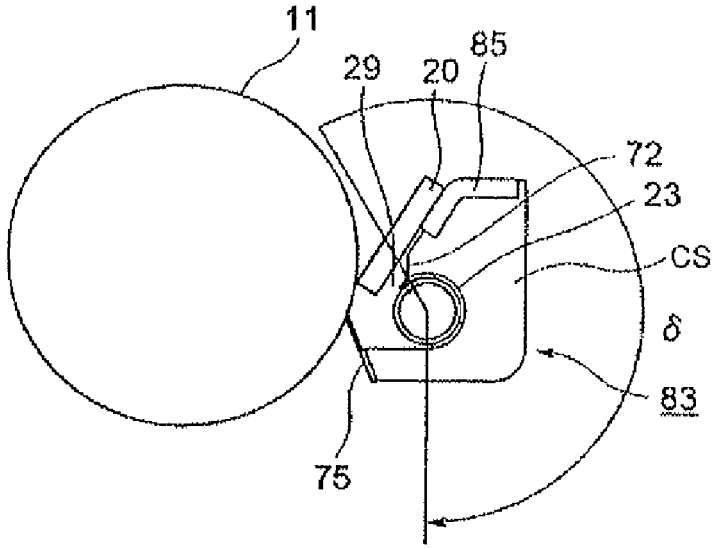
FIG. 8 illustrates the arranging condition of the second cleaning device of the second embodiment.
Figure 9:
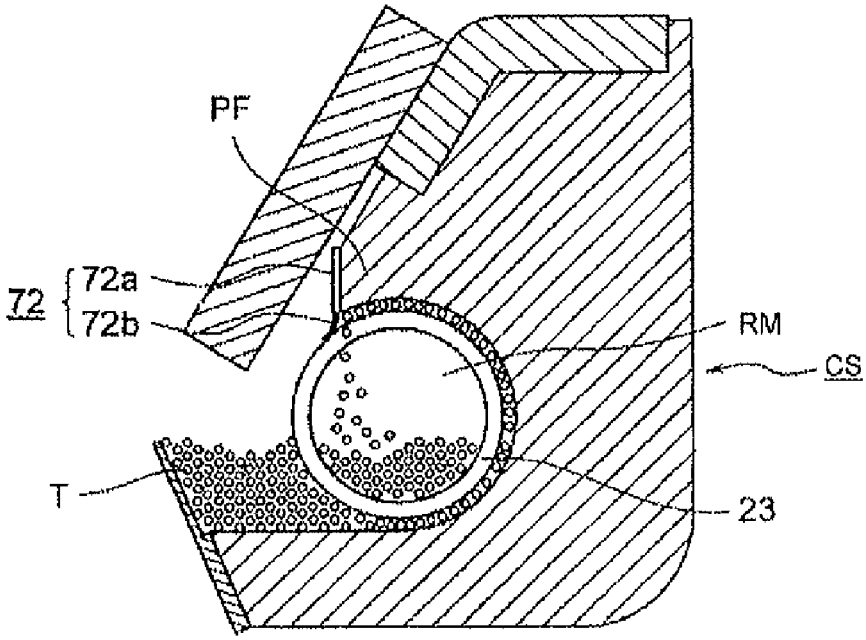
FIG. 9 illustrates the scraping condition of the remaining toner of the second embodiment.

FIG. 8 shows an arrangement condition of a cleaning device of the second embodiment. FIG. 9 shows a scraping condition of the toner remaining in the second embodiment.

In this case, the housing part CS is arranged with an angle δ of approximately 210° centering around a rotation axis of the carrying spiral 23 that is the first carrying member and a rotation carrying member. Also the housing part CS surrounds the bottom part, the side part and the top part of the carrying spiral 23, and has a shape to retain the carrying spiral 23, it also contains room RM for containing the carrying spiral 23. As the containing room RM is formed over a 210° angle that is larger than 180°, it can prevent the carrying spiral 23 from falling outside of the containing room RM. Accordingly, as the carrying spiral 23 is not shifted to the side of photoconductive drum 11 that is the image carrier and is the first developer attaching member in the waste toner containing part 29 that is a waste developer housing part and is a waste developer carrying path, and moreover is securely rotated, the waste toner T that is the waste developer can be smoothly carried.

Subsequently, as shown in FIG. 9 at the top side of the housing part CS, a brush material 72 that is a scraping member and an elastic member is arranged at an edge part PF that is opposed to the cleaning blade 20 that is the second cleaning member. The brush material 72 includes an attaching part 72*a* and a brush part 72*b*, and is fixed on the housing part CS by pasting the attaching part 72*a* at the edge part PF using a double sided tape, as an adhesive member, that is not shown in the figure. Moreover, the brush part 72*b* extends to a lower part, is pushed against the carrying spiral 23, and also enters into each gap (spiral gap) between blades of the carrying spiral 23.

Accordingly, when the carrying spiral 23 is rotated, the waste toner T attached on the periphery of the carrying spiral 23 reaches the vicinity of the upper end of the carrying spiral 23 along with the rotation of the carrying spiral 23, contacts the brush material 72, is scraped by the brush material 72, is dropped in the waste toner containing part 29 and is securely collected in the carrying spiral 23. Accordingly, a sufficient amount of the waste toner T can be carried by the carrying spiral 23, and can be sent to the waste toner delivering part.

As stated above, in the present embodiment, as the waste toner T is scraped by the brush material 72, the contact area of the brush material 72 and the carrying spiral 23 can be extremely small. Accordingly, the brush material 72 does not create a large load against the rotation of the carrying spiral 23.

In the present embodiment, the second cleaning device 83 is configured to remove the waste toner T from the photoconductive drum 11. However, the present invention can be adapted for use with the first cleaning device 82 to remove the toner attached on the endless belt 81 as the waste toner T.

This disclosure is intended to explain how to fashion and use various embodiments in accordance with the invention rather than to limit the true, intended, and fair scope and spirit thereof. The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A cleaning device comprising:

a cleaning member for removing developer attached to a developer attaching member;

a rotation carrying member which is rotatably configured to carry the developer that is removed by the cleaning member;

a housing member for housing the developer that is removed by the cleaning member, and configured as a part of a developer housing part that surrounds the rotation carrying member; and an elastic member arranged to contact a periphery of the rotation carrying member, wherein the elastic member contacts the rotation carrying member at an upper part of the rotation carrying member, and the rotation carrying member is configured to move toward the housing member.

2. The cleaning device of claim 1, wherein the rotation carrying member moves toward the housing member due to a friction force generated between the rotation carrying member when rotating and the elastic member.

3. The cleaning device of claim 1, wherein the elastic member is fixed in the housing part.

4. The cleaning device of claim 1, wherein the elastic member is disposed on an entire length of the housing part in the axial direction of the rotation carrying member, and contacts the rotation carrying member over an entire length of the rotation carrying member in the axial direction of the rotation carrying member.

5. The cleaning device of claim 1, wherein the elastic member comprises a sponge and is disposed in a space between a supporting member that supports the cleaning member and the housing part.

6. The cleaning device of claim 1, wherein the elastic member is arranged on an upstream side of the cleaning member in the rotation direction of the rotation carrying member.

7. The cleaning device of claim 1, wherein the housing member is configured to house the rotation carrying member.

8. The cleaning device of claim 1, wherein the developer attaching member comprises an image carrier.

9. The cleaning device of claim 1, wherein the developer attaching member comprises an endless belt.

10. The cleaning device of claim 1, wherein the developer is waste developer.

11. The cleaning device of claim 1, wherein the developer is recycle developer.

12. The cleaning device of claim 1, wherein the rotation carrying member is pressed by the elastic member, and the rotation carrying member contacts the housing member at a contacting part on an opposite side from a contacting position with the elastic member.

13. The cleaning device of claim 12, wherein the rotation carrying member receives in accordance with its rotation a reaction force Fa at the contacting part, the reaction force Fa being in a leaving direction away from the developer attaching member and another reaction force Fb at the contacting part, the reaction force Fb being in an approaching direction toward the developer attaching member; and the reaction force Fa is greater than the reaction force Fb.

14. An image forming device, comprising:

a cleaning member for removing developer attached to a developer attaching member;

a rotation carrying member rotatably configured to carry the developer that is removed by the cleaning member;

a housing member for housing the developer that is removed by the cleaning member, and configured as a part of a developer housing part that surrounds the rotation carrying member; and an elastic member arranged to contact a periphery of the rotation carrying member, wherein the elastic member contacts the rotation carrying member at an upper part of the rotation carrying member, and the rotation carrying member is configured to move toward the housing member.

15. A cleaning device for a developer attaching member of an image forming device, the cleaning device comprising:

a housing including a developer tank for storing waste developer;

a cleaning member located within the housing and configured to remove the developer from the developer attaching member;

a carrying member rotatably configured within the housing to carry the developer removed by the cleaning member to the developer tank; and an elastic member arranged to contact a periphery of the carrying member, wherein the elastic member contacts the rotation carrying member at an upper part of the rotation carrying member, and the carrying member is configured to move toward the housing.

16. The cleaning device of claim 15, wherein the housing further comprises a toner carrying structure configured to receive the waste developer from the carrying member and to send the waste developer to the waste developer tank.

17. The cleaning device of claim 15, wherein the elastic member comprises a sponge.

18. The cleaning device of claim 15, further comprising a film that seals a gap between the developer attaching member and the housing to seal the waste developer in the housing.

* * * * *